US008801314B2

(12) United States Patent
Yamanaka

(10) Patent No.: US 8,801,314 B2
(45) Date of Patent: Aug. 12, 2014

(54) CONICAL NIB AND WRITING INSTRUMENT USING THE SAME

(76) Inventor: Shizuo Yamanaka, Mitaka (JP)

( * ) Notice: Subject to any disclaimer, the term of this patent is extended or adjusted under 35 U.S.C. 154(b) by 454 days.

(21) Appl. No.: 13/223,773

(22) Filed: Sep. 1, 2011

(65) Prior Publication Data

US 2012/0057924 A1 Mar. 8, 2012

(30) Foreign Application Priority Data

Sep. 1, 2010 (JP) ..... P2010-195316
Dec. 7, 2010 (JP) ..... P2010-272258
Jul. 12, 2011 (JP) ..... P2011-154156

(51) Int. Cl.
*B43K 1/02* (2006.01)
*B43K 5/00* (2006.01)

(52) U.S. Cl.
USPC ..... 401/231; 401/221; 401/235

(58) Field of Classification Search
CPC ..... B43K 1/003; B43K 1/02; B43K 1/06; B43K 8/02
USPC ..... 401/221, 222, 224, 231, 233, 235, 265, 401/292
See application file for complete search history.

(56) References Cited

U.S. PATENT DOCUMENTS 5,902,064 A * 5/1999 Yamanaka ..... 401/292
5,957,610 A * 9/1999 Yamanaka ..... 401/221
6,652,177 B2 * 11/2003 Shimada et al. ..... 401/233
8,475,071 B2 * 7/2013 Yamanaka ..... 401/235

* cited by examiner

*Primary Examiner* — David Walczak
*Assistant Examiner* — Jennifer C Chiang
(74) *Attorney, Agent, or Firm* — Browdy and Neimark, PLLC

(57) ABSTRACT

A nib piece with high roundness is obtained in the following manner: in the forming of the nib piece, a punched hole is formed in a base portion of a punched plate which is to be bent; the base portion of the punched plate is bent and shaped into a tubular structure; a pipe member which is aligned with and accommodated in the tubular body, is disposed in an inner portion of the base portion of the punched plate having been bent; and the punched plate is shaped to obtain a structure to wrap an outer periphery of the pipe member. The punched plate includes an engageable joint portion, such as a protrusion and a recess, which engage each other and form a hooked edge when the punched plate is bent into a cylindrical form.

7 Claims, 22 Drawing Sheets

(a)

(b)

(a)

(b)

CONICAL NIB AND WRITING INSTRUMENT USING THE SAME

BACKGROUND OF THE INVENTION

1. Field of the Invention

The present invention relates to a conical nib and a writing instrument using the same.

More particularly, the invention relates to a conical nib with parts assembled with high precision and a writing instrument using the same.

2. Description of the Related Art

A writing instrument including such a nib is described in Patent Literature 1. The nib of the writing instrument described in Patent Literature 1 is provided with a nib base body and a converging member. The nib base body is constituted by a cylindrical base portion and five to eight combtooth-like pieces. The combtooth-like pieces, each having an arc-shaped cross section, extend continuously from one end of the cylindrical base portion. The combtooth-like pieces are arranged at equal intervals on the circumference of the cylindrical base portion and are divided by slits. The combtooth-like pieces define a hemisphere-divided portion at tips thereof. The converging member is a metal pipe capable of fitting onto an outer periphery of the nib base body. When the converging member is fit onto the nib base body, the combtooth-like pieces are gradually tapered toward the tips thereof to form a conical shape. A hemispherical writing tip is defined at the tips of the combtooth-like pieces and ink feed paths are defined between adjacent combtooth-like pieces. An ink relay core having capillary action to a front end thereof is inserted in a hollow of the nib (i.e., the nib base body). The ink relay core is integrally fixed to the front end of a pen shaft and the ink relay core is connected to the ink reservoir inside the pen shaft. The thus-structured nib can be used to write in many directions on a paper sheet. The nib can be used to write at any positions and at any angles, even if the nib is rotated about the pen shaft. Various characters, i.e., characteristics of varying width, can be written in accordance with varying writing pressure.

A related art of the present technique is disclosed in, for example, Japanese Unexamined Patent Application Publication No. 9-156279.

However, the writing instruments using such conical nibs have difficulty in tip alignment with high precision at the writing tip of the nib and have difficulty in achieving roundness of the nib piece. Thus, there are problems of less smoothness in writing, scratchy writing or a leakage of ink.

Another problem relates to the space inside the nib, i.e., the space between the nib and the ink relay core. If the pen is kept with the nib facing downward with the ink accommodated in the ink reservoir, the ink is collected inside the nib (i.e., the space between the nib and the ink relay core) due to the gravity and capillary action of the ink at the nib (i.e., the ink feed path) and of the ink relay core. If the amount of ink is substantially full of the ink reservoir, there is no (or small, if any) expansion of air resulting from the change in temperature or pressure inside the ink reservoir and thus no leakage of ink occurs; but if the amount of ink is reduced less than half the ink reservoir, expansion of air resulting from the change in temperature or pressure in the ink reservoir becomes greater, and the air pressure may cause a leakage of ink.

The present invention is made to solve these related art problems. A first object of the present invention is to provide a conical nib with a writing tip manufactured with increased precision and a writing instrument using the conical nib.

A second object is to form a nib piece with high roundness and to increase processability in bending and shaping a punched plate during the manufacture of the nib piece.

A third object is to provide a highly rigid structure of the nib piece by holding each part of the nib piece with greater force.

A fourth object is to prevent accumulation of ink in a space between the nib and the ink relay core and to thereby prevent a leakage of ink in this kind of writing instrument.

SUMMARY OF THE INVENTION

In order to achieve the objects described above, a nib according to the present invention is, in summary, a conical nib manufactured by bending and shaping a punched plate into a tubular form, the conical nib including: a nib piece which includes a tubular base portion, formed into a hollow conical body gradually tapering from a lengthwise direction middle portion to a tip thereof, the tip being a hemispherical writing tip, the conical body being provided with multiple narrow gaps at equal intervals which gaps extending from the writing tip to the rear in the same direction as an axial center and along the bus line of the conical body so that the conical body is divided into multiple combtooth-like pieces, and a base end of each combtooth-like piece is connected to the tubular base portion; and an ink relay core which is provided inside the nib piece and extends to reach an inner surface of a tip of the conical body of the nib piece, wherein a protrusion which protrudes from one side toward another side of a joint edge of the base portion of the bent and shaped nib piece and a recess which is formed to receive the protrusion at another side of the joint edge are formed at the joint edges, and the protrusion engages the recess to form a hooked edge. Instead of the protrusion and the recess, a first sawtooth-shaped portion which is formed to protrude from one side toward another side of the joint edge and a second sawtooth-shaped portion which is engageable with the first sawtooth-shaped portion at another side of the joint edge may be provided. Therefore, misalignment in a direction from a tip to the rear of the nib piece is prevented whereby manufacturing precision of the writing tip, where the combtooth-like pieces converge, is increased.

In summary, a writing instrument according to the present invention includes: a pen shaft which includes an ink reservoir containing ink; and a nib which is connected to the ink reservoir, wherein: the nib is manufactured by bending and shaping a punched plate into a cylindrical form, the nib including: a nib piece which includes a tubular base portion, formed into a hollow conical body gradually tapering from a lengthwise direction middle portion to a tip thereof, the tip being a hemispherical writing tip, the conical body being provided with multiple narrow gaps at equal intervals which gaps extending from the writing tip to the rear in the same direction as an axial center and along the bus line of the conical body so that the conical body is divided into multiple combtooth-like pieces, and a base end of each combtooth-like piece is connected to the tubular base portion; and an ink relay core which is provided inside the nib piece and extends to reach an inner surface of a tip of the conical body of the nib piece, wherein a protrusion which protrudes from one side toward another side of a joint edge of the base portion of the bent and shaped nib piece, a recess which is formed to receive the protrusion at another side of the joint edge, or a first sawtooth-shaped portion and a second sawtooth-shaped portion which are modifications of the protrusion and the recess are formed at the joint edges, the protrusion engaging the recess or the first sawtooth-shaped portion fitting into (or engaging) the second sawtooth-shaped portion to form a hooked edge so as to prevent displacement of the nib piece from the tip to the rear; and the nib includes a core cover which is provided to cover the ink relay core inside the nib piece, the core cover being attached to an outer periphery of the ink relay core between the nib piece and the ink relay core, the core cover having an outer shape which allows close contact with an inner periphery of the nib piece at least at the side of the tip of the nib piece, and the core cover being filled in a space between the nib piece and the ink relay core; and the core cover includes a closely adhering portion and an expanding portion, the closely adhering portion being made of an elastic material, compressed against an inner periphery of the nib piece, and pressed against at least the side of a tip of an inner surface of each combtooth-like piece, and the expanding portion expanding between the combtooth-like pieces. This writing instrument, which is as useful as the nib described above, is capable of preventing the ink leaked from the ink relay core from flowing out of a portion other than the writing tip of the nip piece, i.e., from a portion further toward the base portion.

According to the present invention, a tubular body, i.e., a nib piece, with high roundness is obtained in the following manner: in the forming of the nib piece, a punched hole is formed in a base portion of a punched plate which is to be bent; the punched plate is bent and shaped by, for example, curling, a pipe member which is aligned with and accommodated in the tubular body, is disposed (or inserted) in an inner portion of the base portion of the already bent punched plate; and the punched plate is shaped to obtain a structure to wrap an outer periphery of the pipe member. Cylindrical body with high roundness, i.e., nib piece, can be formed. Since the pipe member 37 is disposed inside the already shaped nib piece, the pipe member functions as a reinforcing member of the nib piece.

Since the punched hole is formed in the punched plate, rigidity of the base portion of the punched plate may be lowered and thus the punched plate may be formed into a cylindrical shape easily. This enhances processability in bending and shaping.

In addition, the punched plate is provided with the protrusion and the recess, or the first sawtooth-shaped portion and the second sawtooth-shaped portion which are the modifications of the protrusion and the recess and the protrusion and the recess, or the first and second sawtooth-shaped portions engage each other and form a hooked edge when the punched plate is bent into a cylindrical shape. With this structure, no misalignment occurs between both sides bordering on the hooked edge in the completed nib piece along the lengthwise direction of the nib piece. Therefore, manufacturing precision of the joint portions of the tips of the combtooth-like pieces, i.e., of the writing tip, can be increased. As described above, the present invention provides various advantageous effects.

The thus-structured writing instrument according to the present invention also has an advantageous effect that, since the nib cover is mounted on an outer periphery of the ink relay core between the nib and the ink relay core and the core cover is made to closely adhere at least to an inner periphery of the nib at the tip side of the nib; and a space defined between the nib and the ink relay core is filled up with the core cover, accumulation of ink in the space between the nib and the ink relay core is prevented and thereby leakage of ink can be prevented reliably and, since an outer periphery of the ink relay core is surrounded by the core cover between the nib and the ink relay core, drying up of the nib (i.e., the ink relay core) when the cap is removed can be prevented reliably.

The foregoing and other advantages of the present invention will become more apparent from the following description with reference to the drawings.

BRIEF DESCRIPTION OF THE DRAWINGS

FIG. 24A is a left side view seen from the front end of the pipe member 61; and FIG. 24B is a front sectional view of the pipe member 61; and FIG. 24C is a right side view seen from the front end of the pipe member 61.

FIG. 26A is an end view of the writing tip of the nib piece; and FIG. 26B is a fragmentary perspective view illustrating a positional relationship among adjacent combtooth-like pieces in the writing tip of the nib piece.

FIG. 27A is an end view of the writing tip of the nib piece; and FIG. 27B is a fragmentary perspective view illustrating a displacement relationship among adjacent combtooth-like pieces in the writing tip of the nib piece.

DESCRIPTION OF THE PREFERRED EMBODIMENTS

First Embodiment

Structure of Nib

Figure 1:
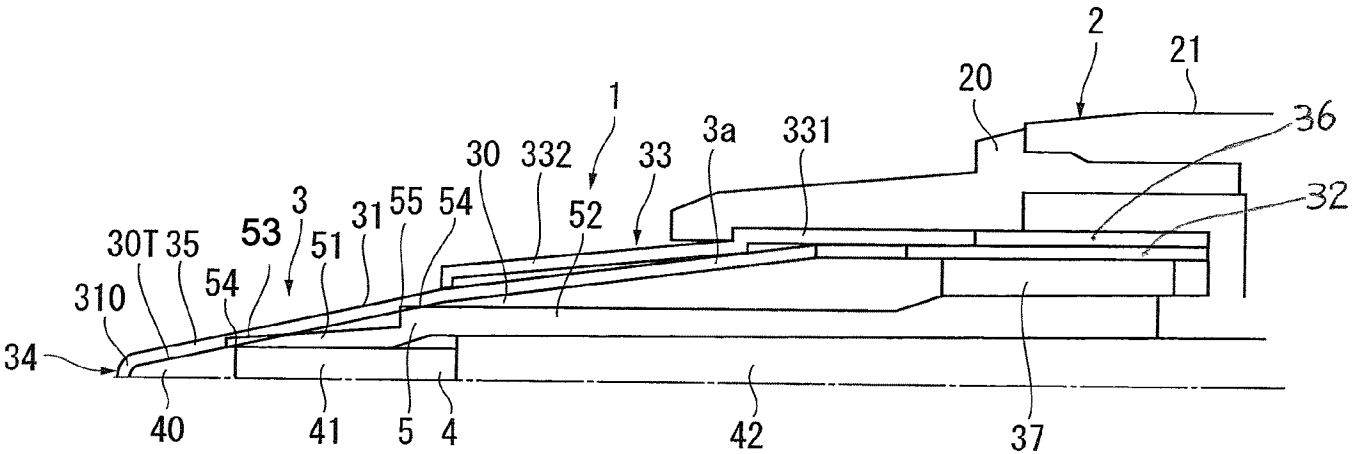
FIG. 1 is a partially cut-away enlarged sectional view of a main part of a nib of a writing instrument according to the first embodiment of the present invention.

FIG. 1 is a sectional view of a structure of a writing instrument according to a first embodiment of the present invention. In FIG. 1, the writing instrument is denoted by a reference numeral 1. As illustrated in FIG. 1, the writing instrument 1 includes a pen shaft 2 and a nib 3. The nib 3 is connected to an ink reservoir (not illustrated throughout the drawings) accommodated inside the pen shaft 2 via an ink relay core 4 which soaks ink by capillary action.

The pen shaft 2 is formed of a plastic material or other materials into a tubular shape, e.g., a cylindrical shape. A mouth piece (i.e., a tubular mouth for fixing the nib 3) 20 is mounted at an end of the pen shaft 2. The mouth piece 20 includes a shaft cylinder 21 which is sealed at a rear end thereof, and an ink reservoir which is integrally formed inside the shaft cylinder 21. In this pen shaft 2, the nib 3 is inserted in and secured to the mouth piece 20 at the front end of the shaft cylinder 21. The ink relay core 4 is inserted in and disposed at an inside of the front end of the shaft cylinder 21. Thus, the ink reservoir is disposed at a predetermined area at a rear side of the ink relay core 4. The ink reservoir is refilled with ink directly. Alternatively, the ink is held by an ink holding member, such as a synthetic fiber converging body, and is supplied to the ink reservoir. A cap (not illustrated) is attached to the front end of the shaft cylinder 21 over the nib 3. The cap is made of a plastic material and has an opening at a rear end thereof. The cap is formed in a tubular, e.g., cylindrical, shape and is closed at a front end thereof. A tubular holding member which airtightly surrounds the nib is integrally provided inside the tubular portion. Therefore, the cap has a dual tubular structure.

Figure 2:
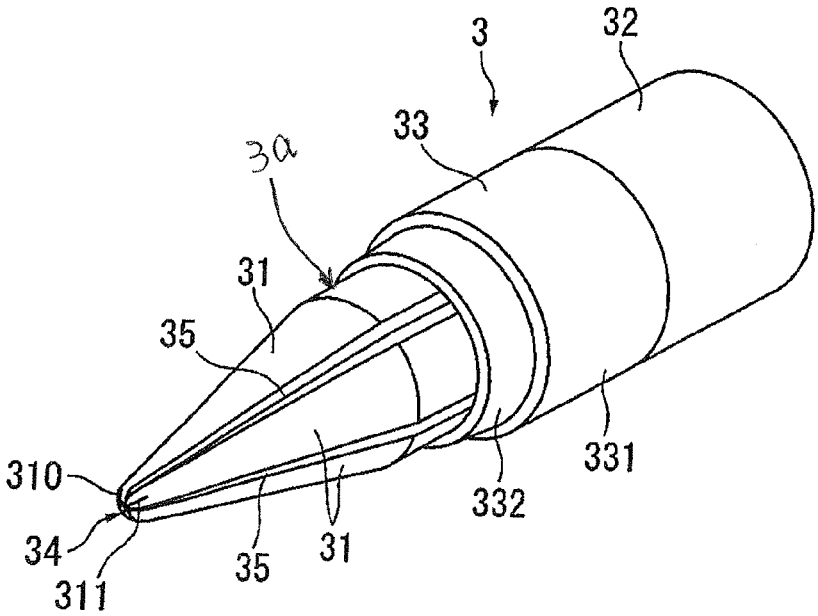
FIG. 2 is an enlarged perspective view of the nib incorporated in the writing instrument according to the first embodiment.

As illustrated in FIG. 2, the nib 3 includes a nib piece 3*a* and a converging member 33. The nib piece 3*a* includes multiple combtooth-like pieces 31, 31, . . . and 31 and a base portion 32 which are integrated with each other. The combtooth-like pieces 31 are made to converge and held by the converging member 33. Here, a structure of the nib piece 3*a* will be described.

Figure 3:
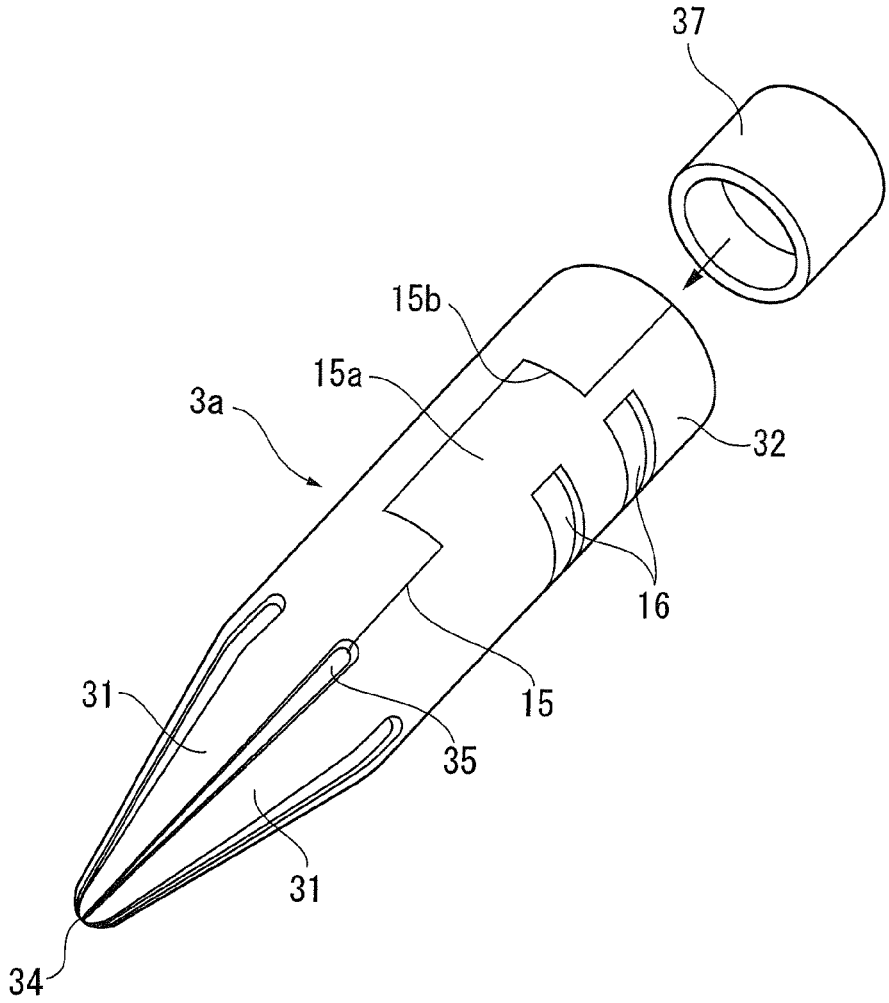
FIG. 3 is a perspective view of an exterior of a nib piece installed in the writing instrument according to the first embodiment.

FIG. 3 illustrates a structure of the nib piece 3*a* according to the first embodiment of the present invention. In FIG. 3, the nib piece is denoted by a reference numeral 3*a* and is made of a corrosion-resistant metallic material, such as stainless steel. The nib piece 3*a* includes a base portion 32 which is formed into a cylindrical shape at the side of the base end. The nib piece 3*a* is tapered from a lengthwise direction middle portion toward the tip thereof. A hemisphere shaped writing tip 34 is formed at the tip. In the conical portion, multiple (e.g., four to eight, six in the embodiment illustrated in FIG. 1) tapered combtooth-like pieces 31 are formed with slits and, on the peripheral surfaces of the combtooth-like pieces 31, ink feed paths 35 consisting of multiple narrow slits extending in the same direction as the axial center and along the bus line of the cone are formed at equal intervals extending rearward from the writing tip 34. The base end of each combtooth-like piece 31 is integrally connected to the tubular base portion 32. This nib piece 3*a* is manufactured in the following manner: a metal sheet material is bent (i.e., curled) into a cylindrical shape and the side of the tip is tapered from the middle portion toward the tip as described above. In this case, a hooked edge denoted by a reference numeral 15 in FIG. 3 is formed at a joint portion of the tubular base portion 32. The hooked edge 15 extends from the base end toward the front end in the base portion 32 and is formed by a rectangular protrusion 15*a* and a rectangular recess 15*b*; the rectangular protrusion 15*a* is provided at one of joint edges and the rectangular recess 15*b* to engage the protrusion 15*a* is provided at the other of the joint edges. The hooked edge 15 reaches a base end (which is the front end when seen from the base portion 32) of the ink feed path 35. The protrusion 15*a* protrudes from one edge to another edge of the hooked edge 15, and the recess 15*b* is recessed to receive the protrusion 15*a* at another edge. With this structure, since the one edge and another edge engage each other bordering on the hooked edge 15 along the lengthwise direction of the nib piece 3*a*, no misalignment occurs between the one edge and another edge in the completed nib piece 3*a*. Therefore, manufacturing precision of a tip of the nib piece 3*a*, i.e., joint portions of the tip of the combtooth-like pieces 31, can be increased. In FIG. 3, a pipe member is denoted by a reference numeral 37, which is fit inside the nib piece 3*a* when the nib piece 3*a* is manufactured by, for example, press forming. Method of manufacturing the nib piece 3*a* will be described later.

Tip ends of the combtooth-like pieces 31 converge and form the hemispherical writing tip 34. Adjoining combtooth-like pieces 31 contact each other in an elastic manner. The writing tip 34 of the nib piece 3*a* has a hemispherical structure (i.e., a hemisphere-divided portion 310 which will be described later) in which tips of the combtooth-like pieces 31 are divided: the tips of the combtooth-like pieces 31 converge and form the writing tip 34. The ink feed paths 35 are formed between joint portions at both sides of the combtooth-like pieces 31, i.e., between adjacent combtooth-like pieces 31.

Preferably, all the outside corners of the tips of the combtooth-like pieces 31 which constitute the writing tip 34 are rounded.

Each of the combtooth-like pieces 31, 31, . . . and 31 has a substantially hemispherical tip. The combtooth-like pieces 31 gradually converge toward the tips thereof to form a substantially conical shape. Each of the combtooth-like pieces 31 is formed in a substantially sword-like shape having an arc-shaped cross-section along the widthwise direction. A hemisphere-divided portion 310 of predetermined dimension is formed at the tip of each combtooth-like piece 31. A single or multiple slits 311 may preferably be formed at the tip of each combtooth-like piece 31 to extend from the tip toward a base end (along the axial direction of the nib 3). The slit(s) 311 of predetermined length is formed linearly from the tip of the combtooth-like piece 31 extending within (or out of) a range of the writing tip 34.

The converging member 33 is made of a metallic material, a resin material or a combination thereof. The converging member 33 includes a substantially cylindrical converging section 331 and a frusto-conical and tubular shaped narrowing section 332 which tapers forward from the converging section 331. The converging section 331 is formed in a cylindrical shape to be fit onto outer peripheries of the combtooth-like pieces 31, 31, . . . and 31 arranged by the base portion 32 along the circumference. The converging section 331 has an outer diameter equivalent to that of the base portion 32, and an inner diameter that can press the base portion 32 from outside toward inside so as to hold the same. The narrowing section 332 has an inner diameter with which the outer diameter and the inner diameter of the converging section 331 taper gradually, the combtooth-like pieces 31, 31, . . . and 31 are pressed from outside toward inside so as to converge them to form a substantially cylindrical shape, and each of the hemisphere-divided portions 310 can be made to converge to form a substantially hemispherical shape. Note that the converging member 33 may be integrally formed with the mouth piece 20 which is used to attach the nib 3 to the shaft cylinder 21 of the pen shaft 2.

In this manner, since the nib piece 3*a* including the combtooth-like pieces 31, 31, . . . and 31 and the base portion 32 is held by and fixed to the shaft cylinder 21 with the mouth piece 20 and the converging member, the converging member 33 converges the combtooth-like pieces 31, 31, . . . and 31 to be a conical shape. The nib is formed in a conical shape including the writing tip 34 at a tip thereof and ink feed paths 35 defined between adjacent combtooth-like pieces 31. A single or multiple slits 311 are formed at the tip of each combtooth-like piece 31 extending from the tip toward the base end and thus the tips of the combtooth-like pieces 31 are further divided. Since the entire tip is formed in a hemisphere shape and is gradually tapered toward the tip, the tips of the combtooth-like pieces 31, 31, . . . and 31 may be formed to be hemispherical as much as possible and the entire nib tip can gradually be converged to be conical as much as possible even if the number of the combtooth-like pieces 31 is small.

Figure 4:
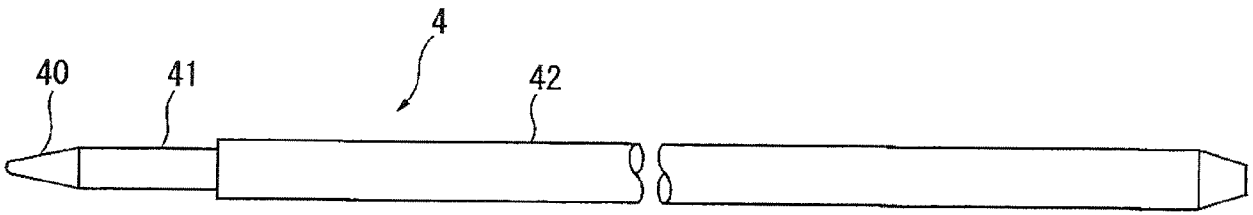
FIG. 4 is a partially cut-away enlarged plan view of an ink relay core incorporated in the writing instrument according to the first embodiment.
Figure 5:
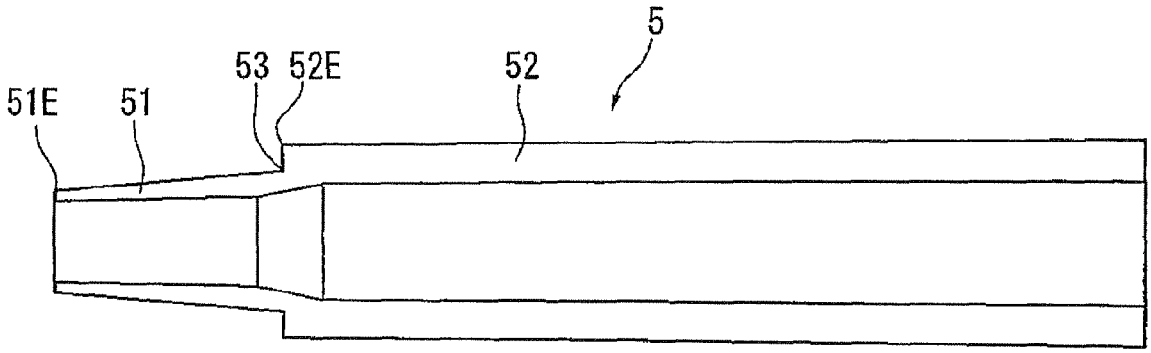
FIG. 5 is an enlarged plan view of a core cover incorporated in the writing instrument according to the first embodiment.

The ink relay core 4 is inserted in the hollow 30 of the nib piece 3*a*. The nib 3 is attached to the tip of the pen shaft 2. A core cover 5 is attached to an outer periphery of the ink relay core 4. The ink relay core 4 herein is a core material (i.e., a fiber aggregate) made of, for example, polyester and other fiber with excellent water retentivity. The ink relay core 4 has a length to be disposed in the nib 3 and the pen shaft 2. As illustrated in FIG. 4, a tip of the ink relay core 4 is formed in a substantially conical shape to be fit in the writing tip 34 of the nib 3 and a hollow tip 30T near the writing tip 34. A rear section of the ink relay core 4 is formed as a round rod. The rear section of the ink relay core 4 is formed as a stepped round rod which includes a front round rod section 41 and a rear round rod section 42. The front round rod section 41 is formed continuously with a substantially conical shaped section 40 at a tip. The rear round rod section 42 continues to the front round rod section 41 with an increased outer diameter. The rear end of the rear round rod section 42 is gradually tapered toward a rear end surface. The core cover 5 is attached to the outer periphery of the ink relay core 4 between the nib 3 and the ink relay core 4. The core cover 5 is made to closely adhere at least to an inner periphery of the nib 3 at the tip side of the nib 3. In this case, the core cover 5 is made of a resin material having elasticity as illustrated in FIG. 5. The core cover 5 has a small-diameter frusto-conical section (or a cylindrical column section) 51 and a large-diameter cylindrical column section 52. The small-diameter frusto-conical section (or a cylindrical column section) 51 is able to hold the tip side of the ink relay core 4 (especially the front round rod section 41). The large-diameter cylindrical column section 52 is able to hold a middle section of the ink relay core 4 (especially a front side of the rear round rod section 42). A stepped portion 53 is provided between the small-diameter frusto-conical section 51 and the large-diameter cylindrical column section 52. A tip outer peripheral edge 51E of the small-diameter frusto-conical section 51 and a front outer peripheral edge 52E of the large-diameter cylindrical column section 52 altogether form an expanding portion 55. The expanding portion 55 enters a groove (i.e., the ink feed path 35) formed between a closely adhering portion 54 and the combtooth-like pieces 31. The closely adhering portion 54 is compressed against an inner periphery of the nib 3 and is pressed against inner surfaces of the combtooth-like pieces 31. The ink relay core 4 is inserted along an axis of the core cover 5 and the conical tip of the ink relay core 4 protrudes from the core cover 5. In this manner, the core cover 5 is attached to an outer peripheral surface of the tip side of the ink relay core 4. The ink relay core 4 is inserted in the hollow 30 from a base end side of the nib 3 to the tip and disposed therein. The tip of the ink relay core 4 is fit in an end of the hollow 3C, i.e., the hollow tip 30T of the writing tip 34 and the neighborhood thereof. A frusto-conical tip edge portion and a cylindrical column-shaped front end edge portion of the core cover 5 are made to closely adhere to the inner periphery of the nib 3. A space defined between the nib 3 and the ink relay core 4 is filled up with the core cover 5 at the tip side of the nib 3. An outer periphery of ink relay core 4 is surrounded by the core cover 5 between the nib 3 and the ink relay core 4. In this manner, the base end side of the nib 3 is fixed to the tip of the pen shaft 2 via the mouth piece 20. The ink relay core 4 is connected to the ink reservoir within the pen shaft 2 (i.e., the shaft cylinder 21).

With this structure of the nib 3, the tips of the combtooth-like pieces 31 are formed to be hemispherical as much as possible and the entire tips of the nibs can be made to gradually converge to be conical as much as possible. In this manner, a hemispherical writing tip 34 having no bias at tip thereof is formed. Certain ink feed paths 35 are defined between adjacent combtooth-like pieces 31. With this structure of the nib 3, when the hemispherical writing tip 34 is pressed against a paper sheet in an inclined manner with respect to the axial center thereof, the hemisphere-divided portions 310 of the combtooth-like pieces 31 shift and elastically deform with respect to one another so as to increase an outer diameter of the hemispherical tip. When the pressing operation against the paper sheet is released, the tip elastically restores its original hemispherical shape. The thus-structured nib can be used to write in many directions on a paper sheet.

The nib can be used to write at any positions and at any angles, even when rotated about the pen shaft 2. The thickness of written lines can be controlled by changing the writing pressure and characters of varying thickness, e.g., brush-characters, can be written in accordance with varying writing pressure. According to the magnitude of the writing pressure, the combtooth-like pieces 31 deflect and absorb the writing pressure. This cushion effect gives a soft pen touch to fingers and a hand of the writer so that the writer will not easily get tired after long hours of writing. The cushion effect also reduces deformation or wear of the nib when the writing pressure is large and thus improves durability of the writing section. Even if the pen is left unused for many hours or moisture on a surface of the nib tip evaporates leaving the ink to dry and narrow gaps at the nib tip to clog, restarting of a writing action causes the writing tip 34 to move and the hemispherical sections are deformed. The narrow gaps are then also deformed to break a dried ink film or block and thus the ink can be easily taken out again. The slit 311 provided at the tip side of the combtooth-like piece 311 also provides elasticity to the writing tip 34. The slits 311 also have a similar ink feeding effect as that provided by the ink feed paths 35. With this structure, the above-described writing performance can be improved as much as possible.

In this writing instrument 1, the core cover 5 is mounted on an outer periphery of the ink relay core 4 between the nib 3 and the ink relay core 4. The core cover 5 is made to closely adhere at least to an inner periphery of the nib 3 at the tip side of the nib 3. A space defined between the nib 3 and the ink relay core 4 is filled up with the core cover 5. With this structure, even if the pen is kept with the nib 3 facing downward, accumulation of the ink in the space between the nib 3 and the ink relay core 4 is prevented and thereby leakage of ink can be prevented reliably. Since an outer periphery of the ink relay core 4 is surrounded by the core cover 5 between the nib 3 and the ink relay core 4, although the nib 3 has a large exposed portion, drying up of the nib 3 (i.e., the ink relay core 4) when the cap is removed can be prevented reliably.

The combtooth-like pieces 31 are provided separately from the base portion 32 in the nib 3 and the combtooth-like pieces 31 are assembled to the base portion 32 to converge into a conical shape by the converging member 33 in this embodiment. It suffices that, however, the nib 3 includes a tubular base portion and multiple combtooth-like pieces provided at one end of the base portion. The tips of the combtooth-like pieces converge into a substantially hemispherical shape and the entire combtooth-like pieces tapers toward the tip of the nib 3; and the nib 3 is formed in a conical nib shape including the writing tip at the tip thereof and the ink feed paths defined between the adjacent combtooth-like pieces. For example, the combtooth-like pieces and base portion may be integrated with each other. Alternatively, each of the combtooth-like pieces may be converged (into a conical shape) and thus the converging member may be omitted. In such a nib structure, a similar operation effect can be obtained by attaching the core cover to the ink relay core with the ink relay core being inserted in the hollow of the nib.

Method of Manufacturing Nib Piece

Figure 6:
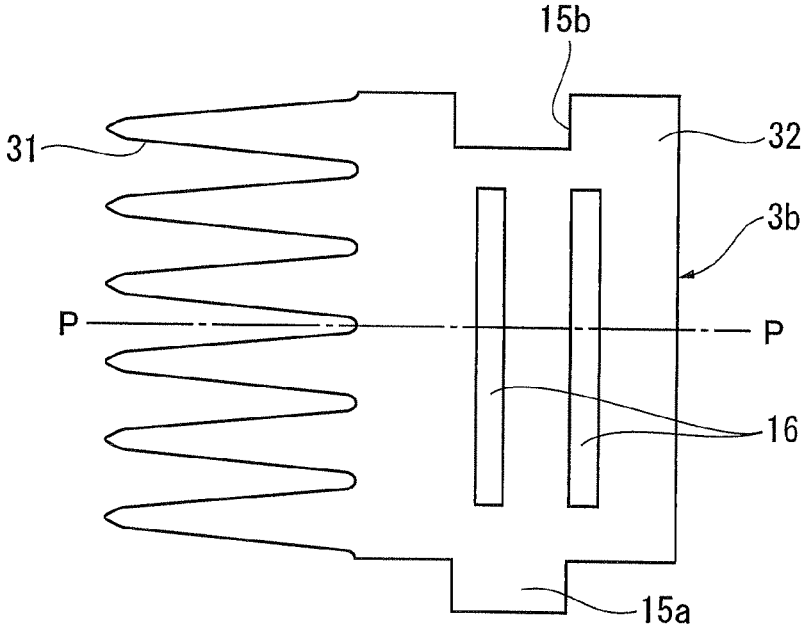
FIG. 6 is a plan view illustrating an original form of the nib piece which has been pressed and punched from a metal sheet in an exemplary method of manufacturing the conical nib according to the first embodiment.
Figure 7:
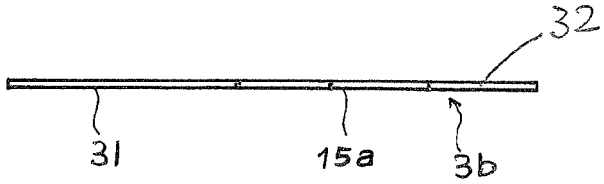
FIG. 7 is a side view of the original form of the nib illustrated in FIG. 6.

Next, an embodiment of a method of manufacturing the nib piece 3*a* according to the present invention will be described with reference to FIGS. 6 to 16. In this example, a method of manufacturing a nib piece from a metal plate member, such as stainless steel. First, as illustrated in FIG. 6, a punched plate 3*b* is fabricated by press punching a stainless steel plate. The punched plate 3*b* includes a strip shaped section at the side of the base portion 32 and multiple (e.g., four to eight, six in the example illustrated in FIG. 6) combtooth-like pieces 31 at the side of the tip. In FIG. 6, the left side is the side of the tip and the right side is the side of the base end. In the press punched state, the tips of the combtooth-like pieces 31 of the punched plate 3*b* still do not converge and is flat when seen as a side view as illustrated in FIG. 7. A rectangular protrusion 15*a* is formed at one side edge of the punched plate 3*b* and a rectangular recess 15*b* capable of fitting into (or engaging) the protrusion 15*a* is provided at the other side edge of the punched plate 3*b*. These side edges, i.e., the protrusion 15*a* and the recess 15*b*, form an above-described hooked edge 15 when the nib piece 3*a* is completed. In the base portion 32 of the punched plate 3*b*, rectangular and elongated punched holes 16 are formed extending between the side edges of the punched plate 3*b*. The punched holes 16 reduce rigidity of the base portion 32 of the punched plate 3*b* made of a metal plate material and facilitate forming (e.g., bending) of the punched plate 3*b*. Shape and size of the punched holes 16 are determined in accordance with rigidity intended for the punched plate 3*b*.

Figure 8:
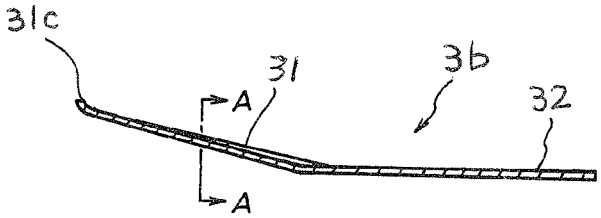
FIG. 8 is a side sectional view of a combtooth-like piece rounded into circular arc shape from the original form of the nib illustrated in FIG. 6, bent into substantially L shape and then curled at a tip thereof by pressing in a method of manufacturing the conical nib according to the present invention.
Figure 9:
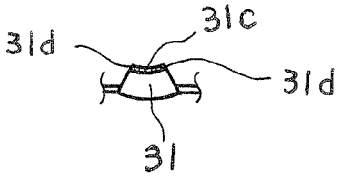
FIG. 9 is a sectional view taken along line A-A of FIG. 8.

After the punched plate 3*b* is press punched as described above, each combtooth-like piece 31 is bent by press forming at its center line into an arc shape and the punched plate 3*b* is bent into a "substantially L shape" from its base and the tip 31*c* of each combtooth-like piece 31 is rounded in the direction in which the punched plate 3*b* is bent into the "substantially L shape" as illustrated in FIG. 8. FIG. 9 is a sectional view of the obtained combtooth-like piece 31 taken along line A-A of FIG. 8.

Before beginning the next process, outer edges, which are cut surfaces, and surfaces of each combtooth-like piece 31 of the punched plate 3*b* are subject to slight polishing by an appropriate method, such as spraying abrasive grains in blast finishing or polishing in barrel finishing, so as to obtain round corners 31*d* of the outer edges and smooth surfaces of the combtooth-like piece 31. This process is required to round both the corners of the ink feed path 35 illustrated in FIG. 3 into a substantially fixed shape and is preferably made, for the mass production of the combtooth-like pieces 31, at this time, i.e., after the bending into the "substantially L shape" of the combtooth-like piece 31 is finished in the preceding process and before the combtooth-like pieces 31 are made to converge into a conical shape.

Next, as illustrated in FIGS. 10 to 13, the punched plate 3*b* is bent into a cylindrical shape by curling about a central axis P-P extending horizontally in FIG. 6 such that curved recesses of the combtooth-like pieces 31 at the side of the tips face inward; and then adjacent side edges abut each other to form the nib piece 3*a*. If the pressure force caused by the curling is released, spring back occurs (though in a small amount) in the cylindrically shaped punched plate 3*b* and gaps appear between the side edges abutting each other. In order to prevent this phenomenon, as a first stage, a pipe member 37 is inserted in the base portion 32 of the cylindrically shaped nib piece 3*a* in the direction of arrow S in FIG. 10. Then, as a second stage, a cylindrical press holder 36 is made to fit along the outer periphery of the nib piece 3*a* from the tip side of the nib piece 3*a* (see FIG. 1). The press holder 36 is press inserted in the pressing operation to reach the rear end of the base portion 32 of the nib piece 3*a*. During the press insertion of the press holder 36, the pipe member 37 supports the base portion 32 of the nib piece 3*a* from inside, and is aligned with and accommodated in the cylindrical base portion 32. Then, the converging member 33 is similarly made to fit along the outer periphery of the nib piece 3*a* from the side of the tip of the nib piece 3*a*. The converging member 33 is press inserted in the pressing operation to reach the press holder 36 in the base portion 32 of the nib piece 3*a*. The pipe member 37 has a cylindrical structure of which length is equivalent to or shorter than (i.e., may be about the half) the length of the base portion 32 of the nib piece 3*a* in the axial direction. The pipe member 37 includes a through hole in the axial direction thereof. When the punched plate 3*b* is bent and the press holder 36 and the pipe member 37 are attached, the side edges of adjacent nib pieces 3*a* are made to abut and join with each other. The protrusion 15*a* and the recess 15*b* engage each other to form the hooked edge 15. The pipe member 37 remains inside the nib piece 3*a* after bending of the punched plate 3*b* is completed. In this manner in which the press holder 36 is press inserted in the outer portion via the pipe member 37 disposed inside the nib piece 3*a* after the bending operation of the punched plate 3*b*, a cylindrical body which is excellent in roundness and precision can be formed as compared with that formed by a (common) method of merely bending a plate material into a cylindrical shape. Since the pipe member 37 is disposed inside the already shaped nib piece 3*a*, the pipe member 37 also functions as a reinforcing member of the nib piece 3*a*. The ink relay core 4 and the core cover 5 extend through the through hole of the pipe member 37 inside the nib piece 3*a*. The punched holes 16 formed in the punched plate 3*b* may lower the rigidity of the base portion 32 of the punched plate 3*b* and thus the punched plate 3*b* can be formed into a cylindrical shape easily. The punched plate 3*b* includes the protrusion 15*a* and the recess 15*b* which engage each other to form the hooked edge 15 when the punched plate 3*b* is bent into a cylindrical shape. With this structure, no misalignment occurs between both sides bordering on the hooked edge 15 in the completed nib piece 3*a* along the lengthwise direction (i.e., the axial direction P-P) of the nib piece 3*a*. Therefore, manufacturing precision of the joint portions of the tips 31*c* of the combtooth-like pieces 31, i.e., of the writing tip 34, can be increased.

Figure 11:
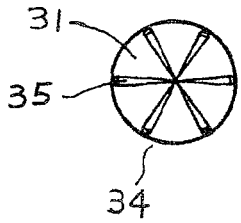
FIG. 11 is an end view of a conical end of the nib piece illustrated in FIG. 10 seen from the line B-B of FIG. 10.
Figure 12:
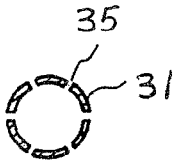
FIG. 12 is a sectional view taken along line C-C of FIG. 10 illustrating a structure of conical portion of the nib piece illustrated in FIG. 10.
Figure 13:
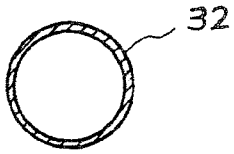
FIG. 13 is a sectional view taken along line D-D of FIG. 10 illustrating a structure of base portion of the nib piece illustrated in FIG. 10.

After the punched plate 3*b* is formed in the tubular shape as described above, the joint portion may be welded by, for example, spot welding and seam welding, in order to further reinforce the cylindrical body. This welding process may or may not be included. This is because a sufficiently rigid nib piece 3*a* is manufactured by attaching the press holder 36 and the pipe member 37 to the punched plate 3*b* which is already formed into a tubular shape; thus the welding process may be performed depending on the tubular structure. Welding process may be performed, however, from the viewpoint of manufacturing precision of the nib piece 3*a*. With the welding process, the strip-shaped base portion 32 serves as the cylindrical base portion 32 of the nib piece 3*a* as illustrated in FIG. 13; the combtooth-like pieces 31 at the side of the tips thereof converge into a conical shape as illustrated in FIG. 12; the tips of the adjacent combtooth-like pieces 31 are in elastic contact with each other; and the tip edges form the hemisphere writing tip 34 as a point of the conical body. That is, the point of the hemisphere body serves as the writing tip 34 and the slots of the joint portions of the combtooth-like pieces 31 serve as the ink feed paths 35 (FIG. 11).

Figure 14:
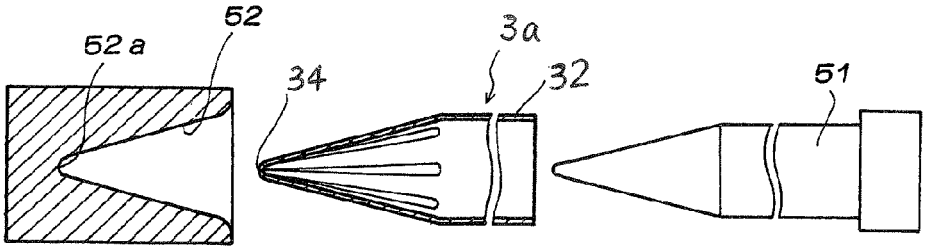
FIG. 14 illustrates forming a point of the nip piece which is manufactured by the processes illustrated in FIGS. 10 to 13 to achieve a more exactly hemisphere body during the manufacture of the conical nib according to the present invention.
Figure 15:
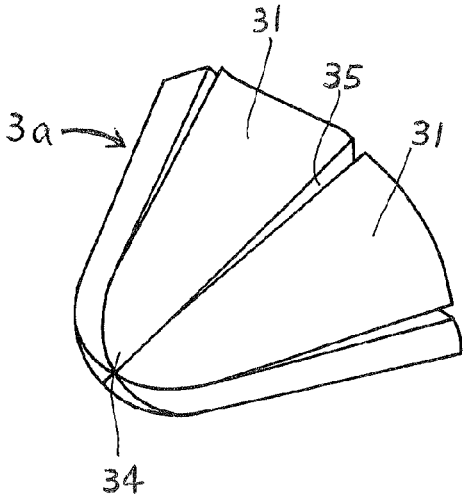
FIG. 15 is an enlarged perspective view of a writing tip of the nib piece formed by forming as illustrated in FIG. 14.
Figure 16:
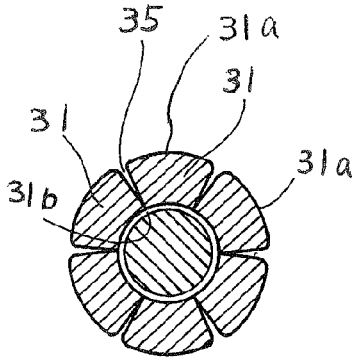
FIG. 16 is a fragmentary sectional view of the writing tip of the nib piece illustrated in FIG. 15.

In order to achieve a more exactly hemisphere writing tip 34, the hemisphere body at the tip and an outer shape of the rearward conical body are subject to a finishing process as illustrated in FIG. 14 in which: a metal core 51 is inserted in the conically-shaped nib piece 3*a* from an open end of the base portion 32; the nib piece 3*a* is then inserted in a hemisphere female die 52 into which the conical nib piece 3*a* is able to fit; and a rear end of the metal core 51 is pressed so that the metal core 51 presses an inner surface of the conical body and an inner surface of the hemisphere body of the nib piece 3*a* to thereby press the conical body and the hemisphere body against an inner wall surface of the female die 52. In this manner, the tips of the combtooth-like pieces 31 form a smooth hemisphere shape and the tips of the combtooth-like piece 31 converge such that adjacent combtooth-like pieces 31 are brought into elastic contact to form the writing tip 34 as illustrated in FIG. 15. As illustrated in FIG. 16, several combtooth-like pieces 31 converge into a circle with a petal-like section at the writing tip 34. Outer peripheries 31*a* of the combtooth-like pieces 31 are pressed against a paper sheet for the writing of something on the paper sheet. The joint portions of the adjacent combtooth-like pieces 31 are slots which gradually expand from an inner contact portion 31*b* toward the outer peripheries; the slots serve as the ink feed paths 35 which feed ink to the writing tip 34.

Second Embodiment

Structure of Nib Piece

Figure 17:
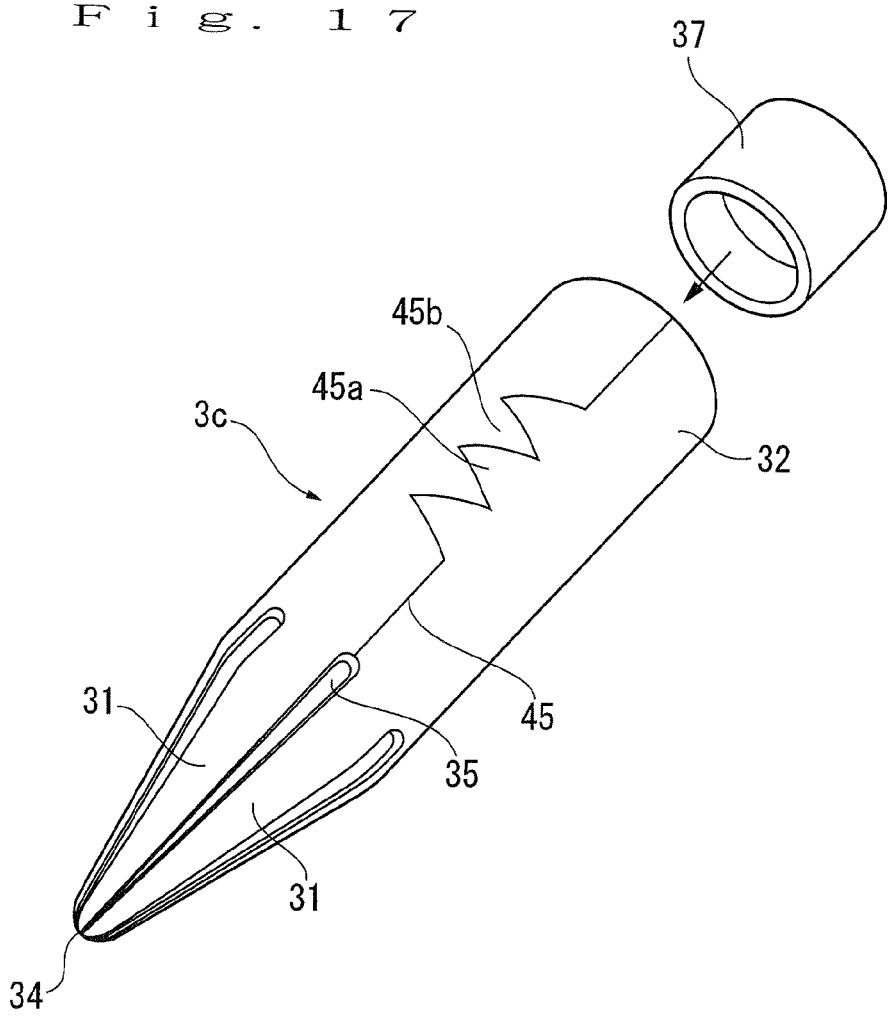
FIG. 17 is a perspective view illustrating an exterior of a nib piece according to a second embodiment of the present invention.

FIG. 17 illustrates a structure of the nib piece 3*c* according to a second embodiment of the present invention. The nib piece 3*c* is substantially the same in structure as the nib piece 3*a* according to the first embodiment. Accordingly, parts illustrated in FIG. 3 are denoted by the same reference numerals in FIG. 17. The nib piece 3*c* according to the second embodiment is manufactured, in a similar manner to that according to the first embodiment; a metal sheet material is bent (i.e., curled) into a cylindrical shape and the side of the tip is tapered from the middle portion toward a tip thereof. Unlike the nib piece 3*a* according to the first embodiment, the nib piece 3*c* has no punched hole 16 formed therein. A hooked edge denoted by a reference numeral 45 in FIG. 17 is formed at a joint portion of the cylindrically shaped base portion 32. The hooked edge 45 differs from the hooked edge 15 according to the first embodiment in its structure. That is, the hooked edge 45 extends from a base end to a front end of the base portion 32. In the middle of the hooked edge 45, a sawtooth-shaped portion (hereinafter, "first sawtooth-shaped portion") 45*a* is formed at one of the joint edges. Another sawtooth-shaped portion (hereinafter, "second sawtooth-shaped portion") 45*b* which engages the first sawtooth-shaped portion 45*a* is formed at the other of the joint edges. The hooked edge 45 reaches a base end (which is the front end when seen from the base portion 32) of the ink feed path 35. The first sawtooth-shaped portion 45*a* and the second sawtooth-shaped portion 45*b* are formed such that the first sawtooth-shaped portion 45*a* protrudes from one side of the edges to the other side of the edges of the hooked edge 45. The second sawtooth-shaped portion 45*b* is formed as a recessed sawtooth-shaped portion which engages the first sawtooth-shaped portion 45*a* at the other side of the edges. When the thus-structured nib piece 3*c* is completed, the one edge and another edge engage each other bordering on the hooked edge 45 along the lengthwise direction of the nib piece 3*c*; and therefore no misalignment occurs between the one edge and another edge. Therefore, manufacturing precision of a tip of the nib piece 3*c*, i.e., tip alignment portions of the combtooth-like pieces 31, can be increased. The number of teeth of the first sawtooth-shaped portion 45*a* and the second sawtooth-shaped portion 45*b* are not particularly limited.

Method of Manufacturing Nib Piece

Figure 18:
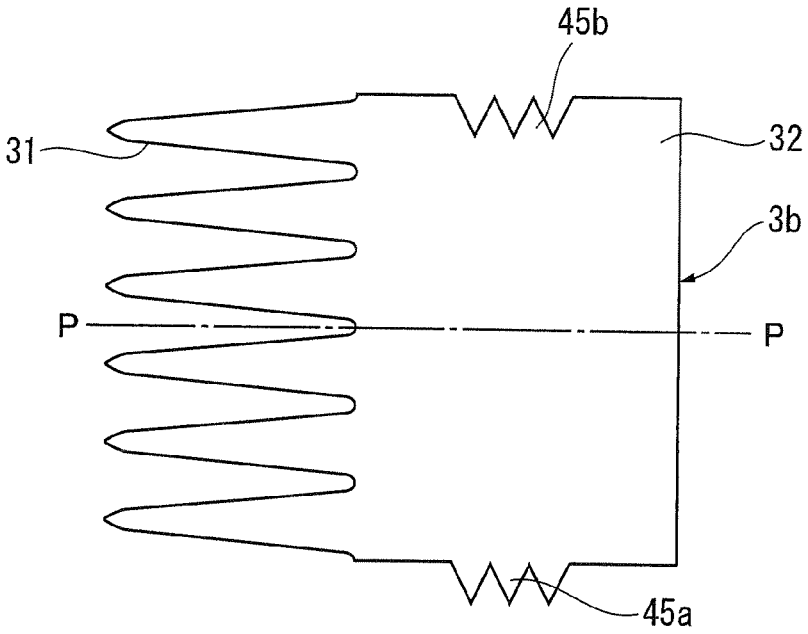
FIG. 18 is a plan view illustrating an original form of the nib piece of a metal sheet which has been pressed and punched from a metal sheet in a method of manufacturing the nib piece according to the second embodiment.

The method of manufacturing the thus-structured nib piece 3*c* is the same as that of the first embodiment. In second embodiment, the first sawtooth-shaped portion 45*a* is formed at one of the side edges, and the second sawtooth-shaped portion 45*b* which may engage the first sawtooth-shaped portion 45*a* is formed at the other of the side edges of the punched plate 3*b* as illustrated in FIG. 18. These side edges, the first sawtooth-shaped portion 45*a* and the second sawtooth-shaped portion 45*b* form the hooked edge 45 when the nib piece 3*c* is completed.

Figure 19:
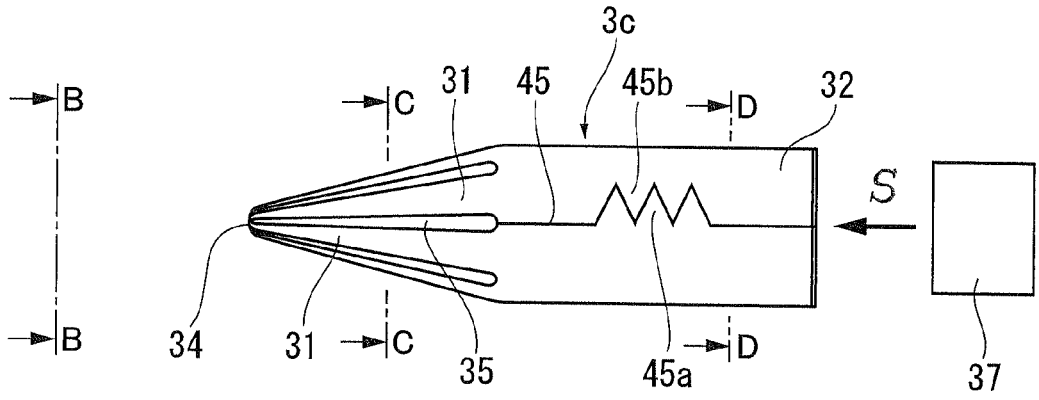
FIG. 19 is a side view illustrating a punched plate manufactured by curling and pressing in a method of manufacturing the nib piece according to the second embodiment.

The subsequent and later manufacturing processes are the same as those of the first embodiment. That is, as illustrated in FIG. 19, the punched plate 3*b* is bent into a cylindrical shape by curling about a central axis P-P extending horizontally in FIG. 18 such that curved recesses of the combtooth-like pieces 31 at the side of the tips face inward; and then adjacent side edges abut each other to form the nib piece 3*c*. If the pressure force caused by the curling is released, spring back occurs (though in a small amount) in the cylindrically shaped punched plate 3*b* and gaps appear between the side edges abutting each other. In order to prevent this phenomenon, as a first stage, a pipe member 37 is inserted in the base portion 32 of the cylindrically shaped nib piece 3*c* in the direction of arrow S in FIG. 19. Then, as a second stage, a cylindrical press holder 36 is made to fit along the outer periphery of the nib piece 3*c* from the side of the tip of the nib piece 3*c* (see FIG. 1). The press holder 36 is press inserted in the pressing operation to reach the rear end of the base portion 32 of the nib piece 3*c*. During the press insertion of the press holder 36, the pipe member 37 supports the base portion 32 of the nib piece 3*c* from inside, and is aligned with and accommodated in the cylindrical base portion 32. Then, the converging member 33 is similarly made to fit along the outer periphery of the nib piece 3*c* from the tip side of the nib piece 3*a*. The converging member 33 is press inserted in the pressing operation to reach the press holder 36 in the base portion 32 of the nib piece 3*c*. The pipe member 37 has a cylindrical structure of which length is equivalent to or shorter than (i.e., may be about the half) the length of the base portion 32 of the punched plate 3*b* in the axial direction. The pipe member 37 includes a through hole in the axial direction thereof. After the punched plate 3*b* is bent and the press holder 36 and the pipe member 37 are attached, the side edges of the nib piece 3*c* are made to abut and joined with each other. The first sawtooth-shaped portion 45*a* and the second sawtooth-shaped portion 45*b* engage each other and form the hooked edge 45. The pipe member 37 remains inside the nib piece 3*c* after bending of the punched plate 3*b* is completed. In this manner in which the press holder 36 is press inserted in the outer portion via the pipe member 37 disposed inside the nib piece 3*c* after the bending operation of the punched plate 3*b*, a cylindrical body which is excellent in roundness and precision can be formed as compared with that formed by a (common) method of merely bending a plate material into a cylindrical shape. Since the pipe member 37 is disposed inside the already shaped nib piece 3*c*, the pipe member 37 also functions as a reinforcing member of the nib piece 3*c*. The ink relay core 4 and the core cover 5 extend through the through hole of the pipe member 37 inside the nib piece 3*c*. The first sawtooth-shaped portion 45*a* and the second sawtooth-shaped portion 45*b* are formed in the punched plate 3*b* and the first sawtooth-shaped portion 45*a* and the second sawtooth-shaped portion 45*b* engage each other and form the hooked edge 45 when the punched plate 3*b* is bent into a cylindrical shape. With this structure, no misalignment occurs between both sides bordering on the hooked edge 45 in the completed nib piece 3*c* along the lengthwise direction (i.e., the axial direction P-P) of the nib piece 3*c*. Therefore, manufacturing precision of the joint portions of the tips 31*c* of the combtooth-like pieces 31, i.e., of the writing tip 34, can be increased. In FIG. 19, line B-B, line C-C and line D-D represent positions of end surfaces or cross sections like line B-B, line C-C and line D-D in FIG. 10. Line B-B represents a position of the side of the tip of the conical shape of the nib piece 3*c* illustrated in FIG. 19; the end surface taken along line B-B has the same structure as that illustrated in FIG. 11. Line C-C represents a position of the cross section of the conical portion of the nib piece 3*c* illustrated in FIG. 19; the cross section taken along line C-C has the same structure as that illustrated in FIG. 12. Line D-D represents a position of the cross section of the base portion of the nib piece 3*c* illustrated in FIG. 19; the cross section taken along line D-D has the same structure as that illustrated in FIG. 13.

Third Embodiment

Modification of Punched Plate

Next, a modification of the punched plate 3*b* used in the manufacture of the nib piece 3*a* or 3*c* according to the present invention will be described. FIGS. 20 to 23 illustrate various modifications of the punched plate 3*b*. These examples are the same as the first and second embodiments in that the punched plate 3*b* is made of metal, such as stainless steel, and that the punched plate 3*b* is fabricated by press punching a stainless steel; the punched place 3*b* includes a strip shaped section at the side of the base portion 32 (i.e., the right side) and multiple (e.g., four to eight, six in the example in this embodiment) combtooth-like pieces 31 at the side of the tip (i.e., the left side) in the manufacture. Multiple (two in FIG. 20) rectangular protrusions 15*c* are provided with spaces therebetween at one of the side edges of the punched plate 3*b* illustrated in FIG. 20; and multiple (two in FIG. 20) rectangular recesses 15*d* which are engageable with the protrusions 15*c* are provided with spaces therebetween at the other of the side edges of the punched plate 3*b*. These side edges, the protrusions 15*c* and the recesses 15*d* form the hooked edge 15 or the hooked edge 45 described above when the nib piece 3*a* or 3*c* according to the first or second embodiment is completed. In the base portion 32 of the punched plate 3*b*, multiple rectangular and elongated punched holes 56 are formed extending between the side edges of the punched plate 3*b* in the direction parallel to the side edges. The punched holes 56 are formed, with respect to the multiple combtooth-like pieces 31 provided at the tip side of the punched plate 3*b*, at positions corresponding to boundaries between the adjacent combtooth-like pieces 31. The punched holes 56 reduce rigidity of the base portion 32 of the punched plate 3*b* made of a metal plate material and facilitate forming (e.g., bending) of the punched plate 3*b*. Shape and size of the punched holes 56 may be changed in accordance with rigidity intended for the punched plate 3*b*.

Figure 20:
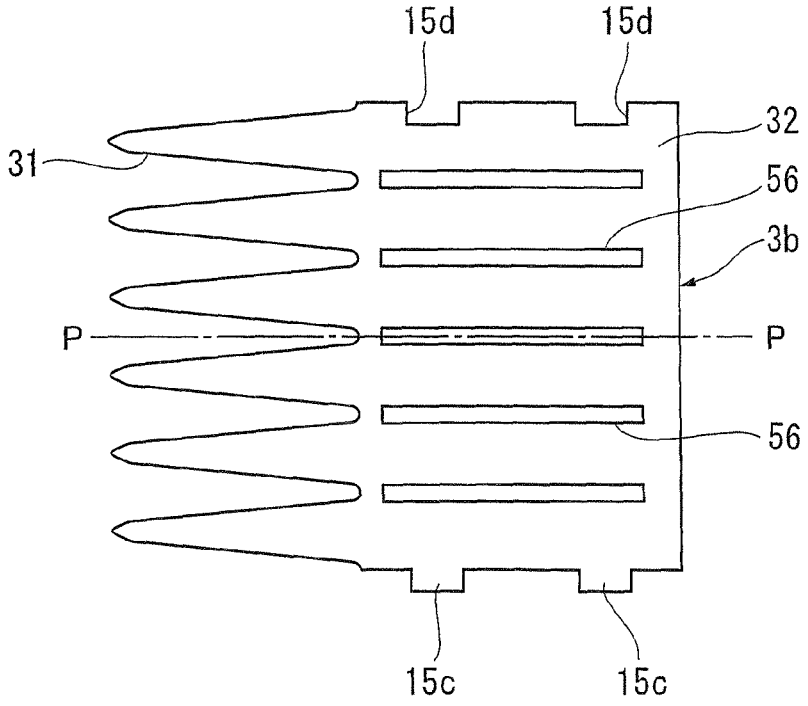
FIG. 20 is a plan view of an original form of a nib piece which has been pressed and punched from a metal sheet according to a third embodiment of the present invention.
Figure 21:
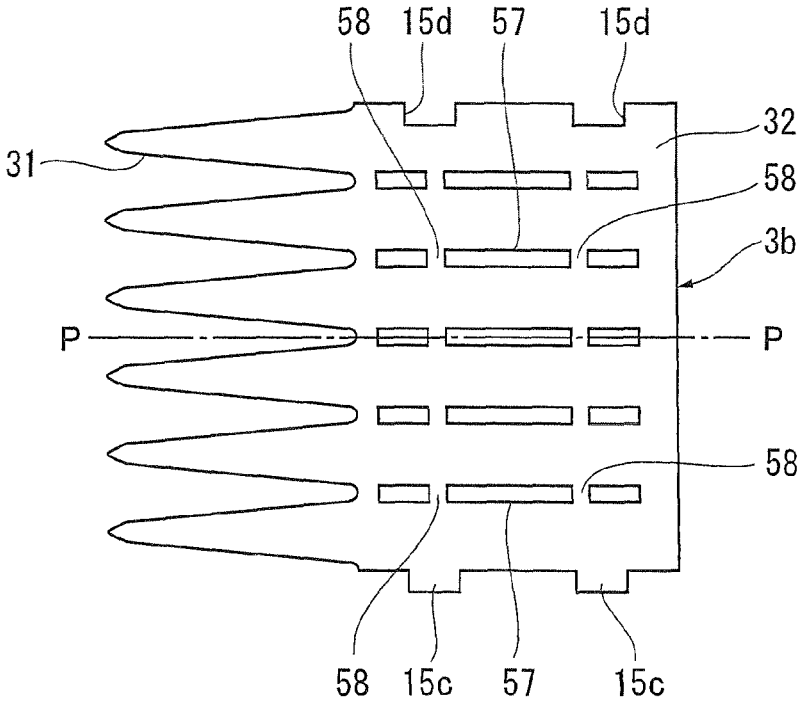
FIG. 21 is a plan view of another example of structure of the original form of the nib piece according to the third embodiment.

Multiple rectangular protrusions 15*c* are provided with spaces therebetween at one of the side edges of the punched plate 3*b* illustrated in FIG. 21 like those illustrated in FIG. 20; and multiple rectangular recesses 15*d* which are engageable with the protrusions 15*c* are provided with spaces therebetween at the other of the side edges of the punched plate 3*b*. In the base portion 32 of the punched plate 3*b*, multiple rectangular and elongated punched holes 57 are formed extending between the side edges of the punched plate 3*b* in the direction parallel to the side edges. The punched holes 57 are formed, with respect to the multiple combtooth-like pieces 31 provided at the tip side of the punched plate 3*b*, at positions corresponding to boundaries between the adjacent combtooth-like pieces 31. Each punched hole 57 includes land portion(s) 58 along the longitudinal direction middle portion thereof.

Figure 22:
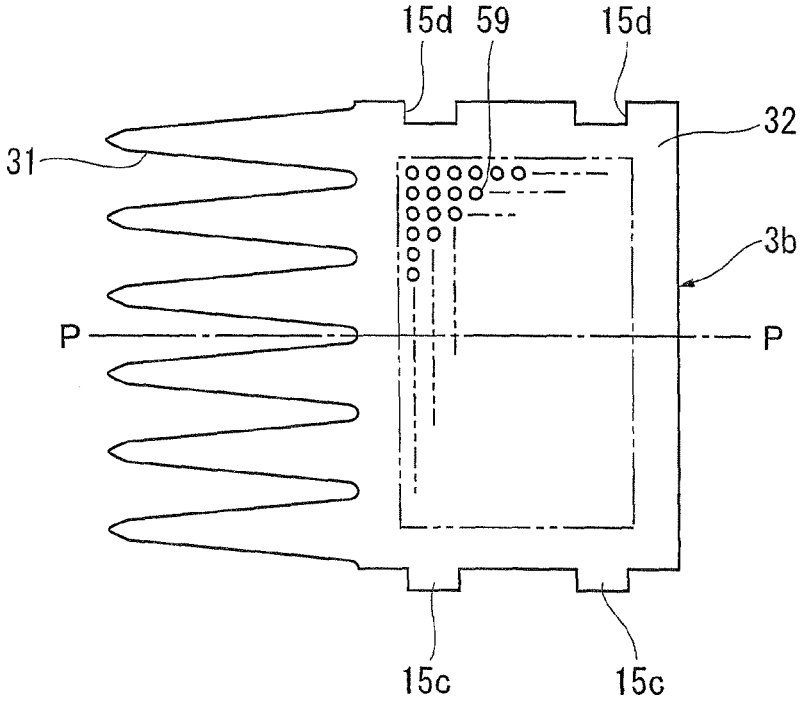
FIG. 22 is a plan view of another example of structure of the original form of the nib piece according to the third embodiment.

Multiple rectangular protrusions 15*c* are provided with spaces therebetween at one of the side edges of the punched plate 3*b* illustrated in FIG. 22 like those illustrated in FIG. 20; and multiple rectangular recesses 15*d* which are engageable with the protrusions 15*c* are provided with spaces therebetween at the other of the side edges of the punched plate 3*b*. Multiple holes 59 are formed in the base portion 32 of the punched plate 3*b* in a distributed manner. The holes 59 may be round, triangular or rectangular in shape.

Figure 23:
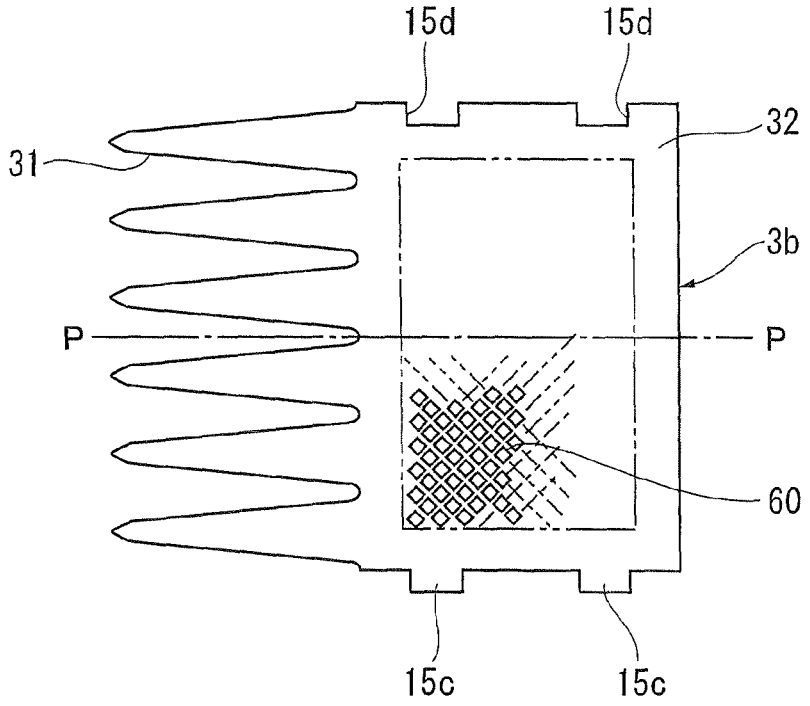
FIG. 23 is a plan view of another example of structure of the original form of the nib piece according to the third embodiment.
Figure 24:
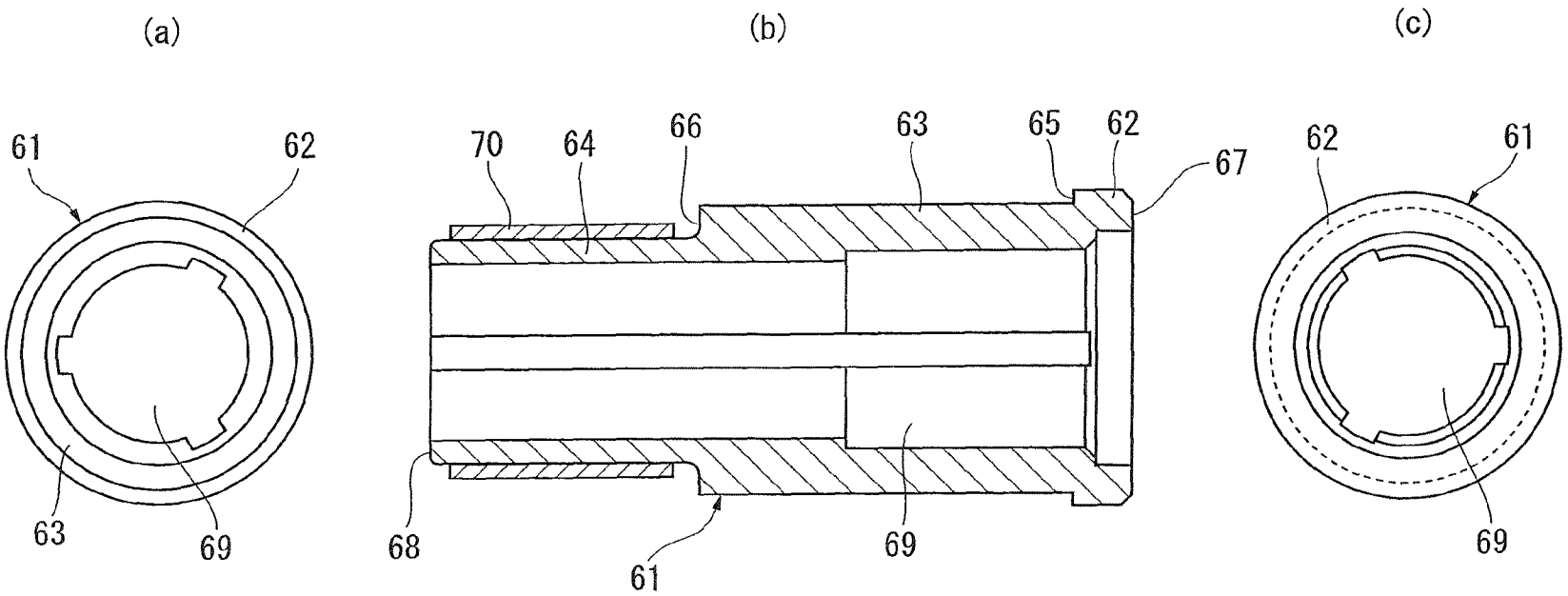
FIGS. 24A to 24C illustrate a structure of a pipe member 61 according to the fourth embodiment of the invention.

Multiple rectangular protrusions 15*c* are provided with spaces therebetween at one of the side edges of the punched plate 3*b* illustrated in FIG. 23 like those illustrated in FIG. 20; and multiple rectangular recesses 15*d* which are engageable with the protrusions 15*c* are provided with spaces therebetween at the other of the side edges of the punched plate 3*b*. Multiple holes 60 are formed in a grid pattern in the base portion 32 of the punched plate 3*b*.

Fourth Embodiment

Modification of Pipe Member and Assembly Structure to Nib

FIGS. 24 to 27 illustrate a modification of the pipe member used for the manufacture of the nib according to the present invention, and an assembly structure thereof to the nib. FIGS. 24A to 24C illustrate a structure of a pipe member 61 according to the fourth embodiment of the invention: FIG. 24A is a left side view seen from the front end of the pipe member 61; FIG. 24B is a front sectional view of the pipe member 61; and FIG. 24C is a right side view seen from the front end of the pipe member 61.

Unlike the pipe member 37 used in the first and second embodiments which has a simple cylindrical structure, the pipe member 61 according to this embodiment has a cylindrical shaped stepped structure, as a whole, and is longer than the pipe member 37. The pipe member 61 includes a base portion 62, a body portion 63 and an end portion 64. A stepped portion 65 is formed on the boundary of the base portion 62 and the body portion 63; the body portion 63 is smaller than the base portion 62 in outer diameter. A stepped portion 66 is formed on the boundary of the body portion 63 and the end portion 64; the end portion 64 is smaller than the body portion 63 in outer diameter. A cavity 69 extending from a base end 67 to an end 68 is formed inside the pipe member 61.

In this embodiment, a buffer member 70 is attached to an outside of the end portion 64 of the pipe member 61. The buffer member 70 is made of an elastic material, such as rubber, and has a pipe structure. Therefore, the buffer member 70 is stretchable in both the lengthwise direction and the diameter direction and is closely attached to the end portion 64 of the pipe member 61. The buffer member 70 may be attached to the end portion 64 of the pipe member 61 to reach the front end 68 or reach the half of the length of the end portion 64. The buffer member 70 may or may not be attached to the end portion 64 of the pipe member 61.

Figure 10:
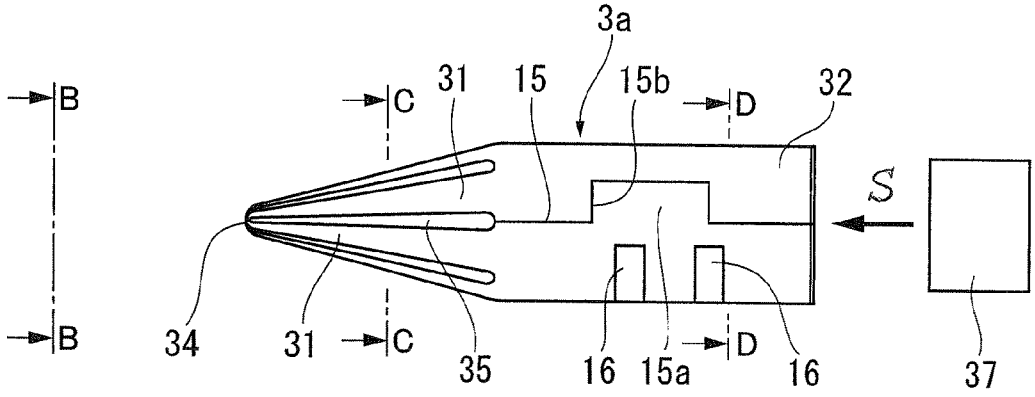
FIG. 10 is a side view of the conical nib in which the original form of the nib illustrated in FIG. 8 is bent at a base end thereof into a cylindrical shape such that the combtooth-like pieces are made to converge into a conical shape by curling and pressing in a method of manufacturing the conical nib according to the present invention.
Figure 25:
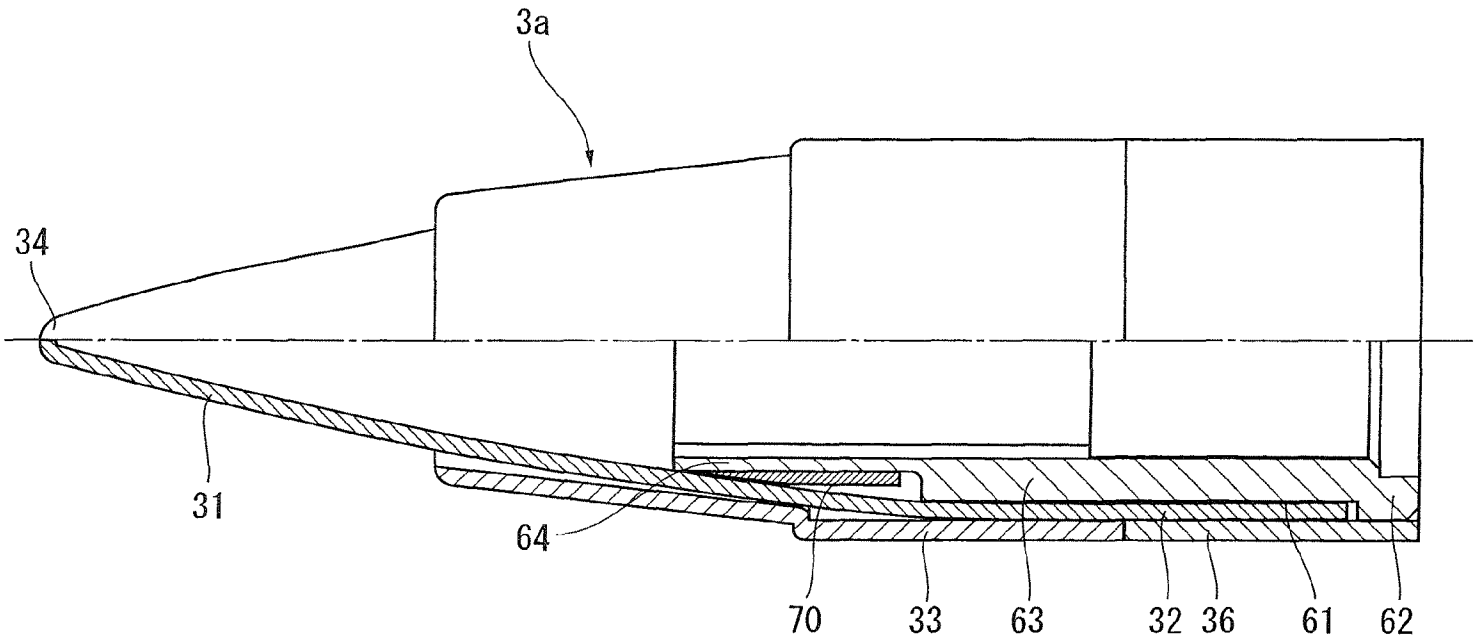
FIG. 25 is a partially sectioned front view of a structure of the nib piece with the pipe member according to the fourth embodiment installed therein.

Manufacture of the nib piece and assembly of the nib will be described with reference to FIG. 10 in accordance with the description of the method of manufacturing the nib piece according to the first embodiment. As illustrated in FIG. 10, the pipe member 61 is inserted in the cylindrically shaped nib piece 3*a* in the direction of arrow S in FIG. 10 from the side of the base portion 32. Then, as a second stage, a cylindrical press holder 36 is made to fit along the outer periphery of the nib piece 3*a* from the side of the tip of the nib piece 3*a* (see FIG. 1). The press holder 36 is press inserted in the pressing operation to reach the rear end of the base portion 32 of the nib piece 3*a*. During the press insertion of the press holder 36, the pipe member 61 supports the base portion 32 of the nib piece 3*a* from inside, and is aligned with and accommodated in the cylindrical base portion 32. Then, the converging member 33 is similarly made to fit along the outer periphery of the nib piece 3*a* from the side of the tip of the nib piece 3*a*. The converging member 33 is cress inserted in the pressing operation to reach the press holder 36 in the base portion 32 of the nib piece 3*a*. A state in which the converging member 33 is press inserted in the base portion 32 of the nib piece 3*a* in this embodiment is illustrated in FIG. 25. Since the pipe member 61 is longer than the pipe member 37 as described above, when the pipe member 61 is inserted in the nib piece 3*a*, the end 68 of the pipe member 61 abuts inner surfaces of the combtooth-like pieces 31 and supports the same from inside. The body portion 63 of the pipe member 61 abuts the inner surface of the base portion 32 of the nib piece 3*a* and supports the same from inside. The base portion 62 of the pipe member 61 abuts the end surface of the base portion 32 of the nib piece 3*a* and supports an end of the base portion 32. With this structure, the nib piece 3*a* is reliably supported from inside by the pipe member 61 from the end of the base portion 32 to the combtooth-like pieces 31, which provides high holding force between multiple combtooth-like piece 31 in the nib.

If the buffer member 70 is attached to the outside of the end portion 64 of the pipe member 61, the buffer member 70 is disposed between the nib piece 3*a* and the pipe member 61 while high holding force is provided between multiple combtooth-like pieces 31. It is therefore advantageous that, since the pipe member 61 surface contacts the inner surface of the nib piece 3*a* and supports the same, the support effect of the pipe member 61 is exhibited in a wider range of the inner surface of the nib piece 3*a*. The buffer member 70 can provide a degree of elasticity to the support effect and can provide buffer effect when the nib receives any impact.

When the punched plate 3*b* is bent and the press holder 36, the pipe member 61 and the converging member 33 are attached, the side edges of adjacent nib pieces 3*a* are made to abut and join with each other. The protrusion 15*c* and the recess 15*d* engage each other to form the hooked edge 15. The pipe member 61 remains inside the nib piece 3*a* after bending of the punched plate 3*b* is completed. In this manner in which the press holder 36 is press inserted in the outer portion via the pipe member 61 disposed inside the nib piece 3*a* after the bending operation of the punched plate 3*b*, a cylindrical body which is excellent in roundness and precision can be formed as compared with that formed by a (common) method of merely bending a plate material into a cylindrical shape. Since the pipe member 61 is disposed inside the already shaped nib piece 3*a* so as to reliably support the nib piece 3*a* from inside from the end of the base portion 32 to the combtooth-like pieces 31, the pipe member 61 functions as a higher performance reinforcing member of the nib piece 3*a*.

Figure 26:
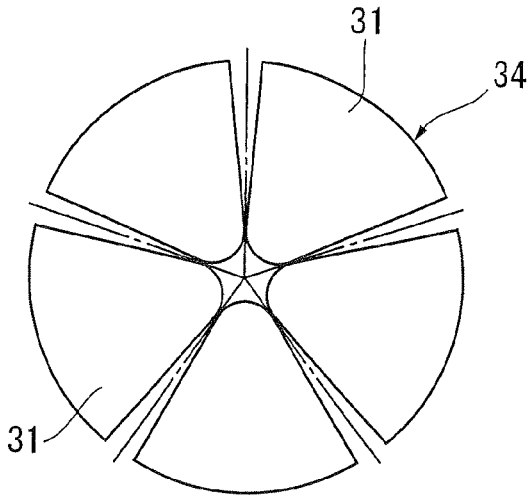
FIGS. 26A and 26B illustrate a state in which no external force is added to the writing tip of the nib piece in which the pipe member according to the fourth embodiment is used.
Figure 26:
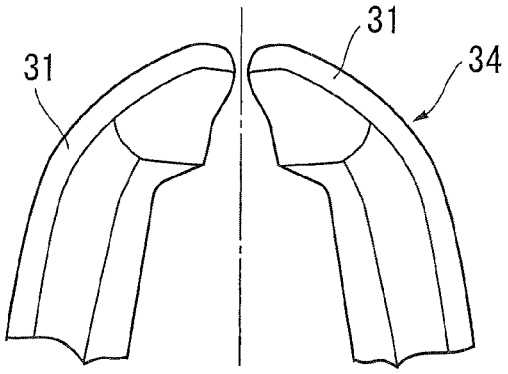
Figure 27:
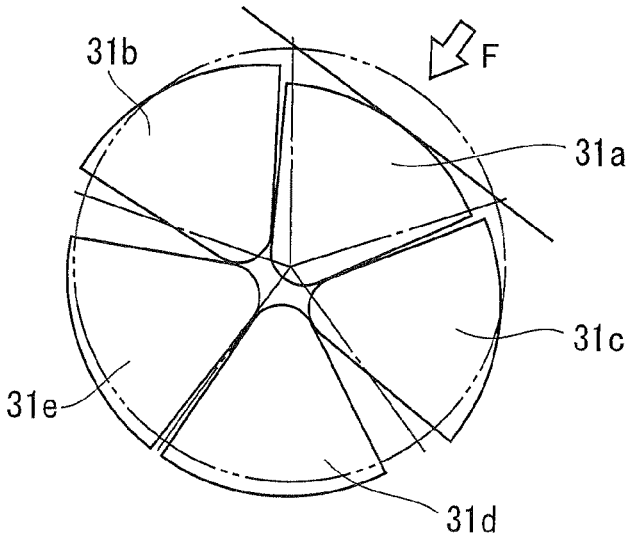
FIGS. 27A and 27B illustrate a state in which external force is added to the writing tip of the nib piece in which the pipe member according to the fourth embodiment is used.
Figure 27:
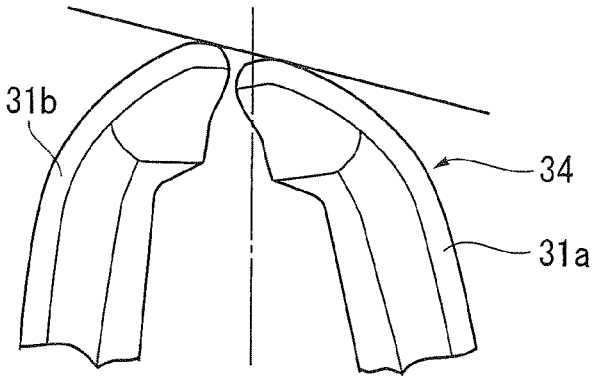

FIGS. 26A, 26B, 27A and 27B are enlarged view of the structure of the writing tip 34 of the nib piece 3*a* according to this embodiment, FIGS. 26A and 26B illustrate a state in which no external force is added to the writing tip 34 and FIGS. 27A and 27B illustrate a state in which external force is added to the writing tip 34. FIG. 26A is an end view of the writing tip 34 of the nib piece 3; and FIG. 26B is a fragmentary perspective view illustrating a positional relationship among adjacent combtooth-like pieces 31 in the writing tip 34 of the nib piece 3*a*. When external force is applied to the writing tip 34, the nib piece 3*a* is clamped by the converging member 33 and the press holder 36 from outside and supported by the pipe member 61 from inside as illustrated in FIGS. 26 and 26B. With this structure, no misalignment occurs among the combtooth-like pieces 31 and therefore a substantially hemispherical writing tip 34 as a whole is obtained. When, on the other hand, external force F represented by an arrow in FIG. 27A is applied to some of the multiple combtooth-like pieces 31 (e.g., the combtooth-like piece 31*a*) as illustrated in FIG. 27A, the combtooth-like piece 31*a* is displaced due to the external force and, as a result, the combtooth-like pieces 31*b* and 31*c* which are adjacent to the combtooth-like piece 31*a* are displaced. The relationship between the displaced combtooth-like piece 31*a* and 31*b* are illustrated in FIG. 27E; the combtooth-like piece 31*a* and 31*b* become different in height of their tips. However, as described above, since the nib piece 3*a* is supported with sufficient force and thus the combtooth-like pieces other than the combtooth-like pieces 31*a*, 31*b* and 31*c* (i.e., 31*d* and 31*e*) are not displaced owing to the sufficient support.

Fifth Embodiment

Second Modification of Pipe Member

Figure 28:
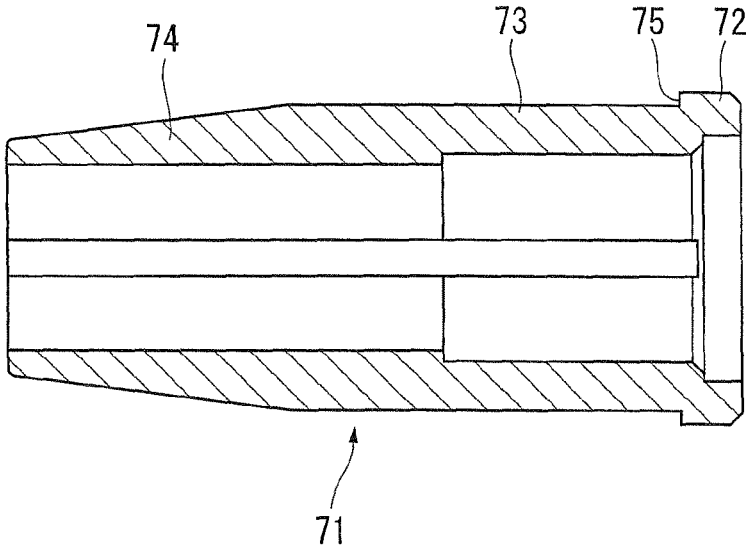
FIG. 28 is a front sectional view of a pipe member according to a fifth embodiment of the present invention.

FIG. 28 is a front view illustrating another modification (i.e., a second modification) of the pipe member used for the manufacture of the nib according to a fifth embodiment of the present invention. A pipe member 71 according to this embodiment includes a base portion 72, a body portion 73 and an end portion 74. The pipe member 71 also includes a cylindrical shaped stepped structure which is substantially the same as that of the pipe member 61 according to the fourth embodiment. That is, a stepped portion 75 is formed on the boundary of the base portion 72 and the body portion 73; the body portion 73 is smaller than the base portion 72 in outer diameter. The pipe member 71 differs from the pipe member 61 according to the fourth embodiment in that the end portion 74 gradually tapers from the base end to the front end thereof. Since the end portion 74 of the pipe member 71 has a tapered structure, the pipe member 71 can substantially surface contacts an inner surface of the nib piece 3*a* and especially inner surfaces of the combtooth-like pieces 31, and support the same. It is therefore advantageous that the support effect of the pipe member 71 is exhibited in a wider range of the inner surface of the nib piece 3*a* as described regarding the buffer member 70.

As described above, a nib piece with high roundness is obtained in the following manner: in the forming of the nib piece, a punched hole is formed in a base portion of a punched plate which is to be bent; the base portion of the punched plate is bent and shaped into a tubular structure; a pipe member which is aligned with and accommodated in the tubular body, is disposed in an inner portion of the base portion of the punched plate which has been bent into the tubular structure; and the punched plate is shaped to obtain a structure to wrap an outer periphery of the pipe member. The pipe member is disposed inside the already shaped nib piece to serve as a reinforcing member of the nib piece. Since the punched hole is formed in the punched plate, rigidity of the base portion of the punched plate may be lowered and thus the punched plate may be formed into a cylindrical shape easily. Since a protrusion and a recess, or first and second sawtooth-shaped portions are provided at edges of the punched plate, the protrusion and the recess, or the first and second sawtooth-shaped portions engage each other and form a hooked edge when the punched plate is bent into a cylindrical shape. With this structure, no misalignment occurs between both sides bordering on the hooked edge in the completed nib piece along the lengthwise direction of the nib piece. Therefore, manufacturing precision of a writing tip can be increased. As described above, the present invention provides various advantageous effects.

What is claimed is:

1. A conical nib manufactured by bending and shaping a punched plate into a tubular form, the conical nib comprising:

a nib piece which includes a tubular base portion, formed into a hollow conical body gradually tapering from a lengthwise direction middle portion to a tip thereof, the tip being a hemispherical writing tip, the conical body being provided with multiple narrow gaps at equal intervals which gaps extending from the writing tip to the rear in the same direction as an axial center and along the conical body so that the conical body is divided into multiple combtooth-shaped pieces, and a base end of each combtooth-shaped piece is connected to the tubular base portion; and an ink relay core which is provided inside the nib piece and extends to reach an inner surface of a tip of the conical body of the nib piece, wherein a protrusion which protrudes from one side toward another side of a joint edge of the base portion of the bent and shaped nib piece and a recess which is formed to receive the protrusion at another side of the joint edge are formed at the joint edges, the protrusion engaging the recess to form a hooked edge so as to prevent displacement of the nib piece from the tip to the rear.

2. The conical nib according to claim 1, wherein a punched hole extending in the direction of the circumference is formed in the base portion of the nib piece.

3. The conical nib according to claim 1, wherein a first sawtooth-shaped portion and a second sawtooth-shaped portion, instead of the protrusion and the recess, are formed at the joint edges of the base portion of the already bent and shaped nib piece, the first sawtooth-shaped portion being formed to protrude from one side toward another side of the joint edge and the second sawtooth-shaped portion being engageable with the first sawtooth-shaped portion at another side of the joint edge, and the first sawtooth-shaped portion and the second sawtooth-shaped portion engageable with each other to form a hooked edge, thereby preventing displacement of the nib piece from the tip to the rear.

4. The conical nib according to any one of claims 1 to 3, wherein a pipe member is disposed inside the tubular base portion of the nib piece and is made to abut an inner surface of the base portion to support the same.

5. The conical nib according to claim 4, wherein a buffer member made of an elastic material is attached to a front end of the pipe member to provide surface contact between the pipe member and the inner surface of the nib piece.

6. The conical nib according to claim 4, wherein the pipe member is disposed inside the nib piece extending from the base end toward an inner position of the combtooth-shaped piece, and the pipe member abuts an inner surface of the nib piece in a range from a base end of the nib piece to the combtooth-shaped piece to support the same.

7. A writing instrument comprising: a pen shaft which includes an ink reservoir containing ink; and a nib which is connected to the ink reservoir, wherein:

the nib is manufactured by bending and shaping a punched plate into a cylindrical form, the nib including: a nib piece which includes a tubular base portion, formed into a hollow conical body gradually tapering from a lengthwise direction middle portion to a tip thereof, the tip being a hemispherical writing tip, the conical body being provided with multiple narrow gaps at equal intervals which gaps extending from the writing tip to the rear in the same direction as an axial center and along the conical body so that the conical body is divided into multiple combtooth-shaped pieces, and a base end of each combtooth-shaped piece is connected to the tubular base portion; and an ink relay core which is provided inside the nib piece and extends to reach an inner surface of a tip of the conical body of the nib piece, wherein a protrusion which protrudes from one side toward another side of a joint edge of the base portion of the bent and shaped nib piece and a recess which is formed to receive the protrusion at another side of the joint edge are formed at the joint edges, the protrusion engaging the recess to form a hooked edge so as to prevent displacement of the nib piece from the tip to the rear;

the nib includes a core cover which is provided to cover the ink relay core inside the nib piece;

the core cover being attached to an outer periphery of the ink relay core between the nib piece and the ink relay core;

the core cover having an outer shape which allows close contact with an inner periphery of the nib piece at least at the side of the tip of the nib piece, and the core cover being filled in a space between the nib piece and the ink relay core; and the core cover includes a closely adhering portion and an expanding portion, the closely adhering portion being made of an elastic material, compressed against an inner periphery of the nib piece, and pressed against at least the side of a tip of an inner surface of each combtooth-shaped piece, and the expanding portion expanding between the combtooth-shaped pieces.

* * * * *